US009218900B2

(12) United States Patent
Birgersson

(10) Patent No.: US 9,218,900 B2
(45) Date of Patent: Dec. 22, 2015

(54) HIGH VOLTAGE BUSHING WITH REINFORCED CONDUCTOR

(71) Applicant: ABB Technology AG, Zurich (CH)

(72) Inventor: Jonas Birgersson, Borlange (SE)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/896,089

(22) Filed: May 16, 2013

(65) Prior Publication Data

US 2013/0248238 A1 Sep. 26, 2013

Related U.S. Application Data

(63) Continuation of application No. PCT/EP2011/069427, filed on Nov. 4, 2011.

(30) Foreign Application Priority Data

Nov. 19, 2010 (EP) ..... 10191798

(51) Int. Cl.
*H01B 17/36* (2006.01)
*H01B 17/26* (2006.01)
*H01B 17/42* (2006.01)

(52) U.S. Cl.
CPC ..... *H01B 17/36* (2013.01); *H01B 17/26* (2013.01); *H01B 17/42* (2013.01)

(58) Field of Classification Search
CPC ..... H01B 17/42; H01B 17/26; H01B 17/36
USPC ..... 174/31 R, 137 R
See application file for complete search history.

(56) References Cited

U.S. PATENT DOCUMENTS

| | | | | | |
|---|---|---|---|---|---|
| 1,983,335 | A | * | 12/1934 | Austin | 174/18 |
| 3,716,652 | A | * | 2/1973 | Lusk et al. | 174/15.3 |
| 3,883,680 | A | * | 5/1975 | Keen, Jr. | 174/12 BH |
| 3,973,077 | A | * | 8/1976 | Classon | 174/15.3 |
| 4,214,118 | A | * | 7/1980 | Gray | 174/15.3 |
| 5,142,104 | A | * | 8/1992 | McArdle | 174/74 R |
| 5,548,081 | A | * | 8/1996 | Rost | 174/14 BH |

(Continued)

FOREIGN PATENT DOCUMENTS

| | | |
|---|---|---|
| EP | 2117015 A1 | 11/2009 |
| EP | 2117016 A1 | 11/2009 |

(Continued)

OTHER PUBLICATIONS

International Search Report and Written Opinion of the International Searching Authority Application No. PCT/EP2011/069427 Completed: Jan. 3, 2012; Mailing Date: Jan. 12, 2012 9 pages.

*Primary Examiner* — William H Mayo, III
*Assistant Examiner* — Hiram E Gonzalez
(74) *Attorney, Agent, or Firm* — Whitmyer IP Group LLC

(57) ABSTRACT

A high voltage bushing including a hollow insulator and a conductor extending through the hollow insulator and including a hollow conductor fixed at the ends of the hollow insulator. The conductor includes a supporting part arranged inside the hollow conductor, the supporting part extends in the longitudinal direction of the hollow conductor and the supporting part is adapted to support the hollow conductor in order to increase the stiffness of the conductor and thereby decrease the static deflection of the conductor in the hollow insulator.

21 Claims, 4 Drawing Sheets

(56) References Cited

U.S. PATENT DOCUMENTS

| | | | | |
|---|---|---|---|---|
| 6,140,573 | A * | 10/2000 | Smith et al. | 174/31 R |
| 2010/0018752 | A1 | 1/2010 | Emilsson et al. | |

FOREIGN PATENT DOCUMENTS

| | | | |
|---|---|---|---|
| JP | 2000331545 | A | 11/2000 |
| JP | 2005176542 | A | 6/2005 |

* cited by examiner

HIGH VOLTAGE BUSHING WITH REINFORCED CONDUCTOR

FIELD OF THE INVENTION

The present invention relates to the field of high voltage technology, and in particular to high voltage devices, such as bushings, for providing electrical insulation of a conductor.

BACKGROUND OF THE INVENTION

High voltage bushings are used for carrying current at high potential through a plane, often referred to as a grounded plane, where the plane is at a different potential than the current path. Bushings are designed to electrically insulate a high voltage conductor, located inside the bushing, from the grounded plane. The grounded plane can for example be a transformer tank or a wall, such as for example a High Voltage Direct Current (HVDC) valve hall wall.

In a gas filled bushing, with a free hanging conductor, for example a wall bushing, the maximum deflection of the conductor in the bushing influences the inner diameter of the bushing which affects the outer diameter of the bushing. In order to prevent flashovers, the higher the maximum deflection is the larger the inside diameter of the bushing has to be. Inside of the bushing, different field control shields are arranged to handle the electrical fields. The field control shields will not work as designed if the conductor is not in the center or close to the center of the bushing. There is thus a need to minimize the deflection of the conductor in very long bushings.

The static deflection of the conductor is generated by gravity and mass of the conductor itself. The conductor in the bushing is in the form of a tube fixed in both ends. The deflection of a horizontally placed tube is dependent on material constants of the conductor tube (Young's modulus and density), length, wall thickness and diameter of the tube.

The conductor is dimensioned to conduct a current i.e. for a given current and resistivity, the cross sectional surface of the conductor is given. For a conductor of a given outer diameter, the wall thickness will be determined by the cross sectional surface of the tube.

The length is set by the length of the bushing which is determined by external electric requirements e.g. voltages and flashover distances.

For large currents it is in principle only possible to use copper or aluminium or alloys thereof in the conductor. This will determine the material parameter which will then set the maximum stiffness of the material.

In total all parameters are set by the electric requirements and then consequently also the maximum static deflection of the tube.

The increasing voltages and very high power distributions that today's equipment has to handle make the bushing very long in the range of 20 m or even longer.

Dynamic deflection of the conductor is generated by seismic forces i.e. earthquakes or other types of vibrations. For the dynamic deflections the resonant frequencies of the conductor is important. Dynamic deflection can under wrong circumstances be much larger than the static deflection and may lead to catastrophic failures.

SUMMARY OF THE INVENTION

Various aspects of the invention are set out in the present teachings.

One embodiment of the present invention provides a high voltage bushing comprising, a hollow insulator, a conductor extending through the hollow insulator and including a hollow conductor fixed at the ends of the hollow insulator.

The conductor comprises a supporting part arranged inside the hollow conductor, the supporting part extends in the longitudinal direction of the hollow conductor and the supporting part is adapted to support the hollow conductor in order to increase the stiffness of the conductor and thereby decrease the static deflection of the conductor in the hollow insulator.

According to an embodiment of the invention, an angle between the longitudinal direction of the conductor in the bushing and the horizontal direction is less than 40 deg. The invention will be particularly well adapted for bushings where the angle between the longitudinal direction of the conductor in the bushing and the horizontal direction is less than 20 deg. The effect of the gravitational deflection of the conductor increases as the angle between the longitudinal direction of the conductor in the bushing and the horizontal direction get smaller.

According to an embodiment of the invention, a high voltage bushing, wherein the increased stiffness of the hollow conductor with the supporting part makes the static deflection of the hollow conductor with the supporting part less than the static deflection of the hollow conductor alone, even if the supporting part adds weight to the conductor.

According to an embodiment of the invention, the supporting part is in contact with at least part of an inner surface of the hollow conductor.

According to an embodiment of the invention, the supporting part is adapted to change the resonant frequency of the conductor, which damps the oscillations during an earth quake.

According to an embodiment of the invention, the supporting part comprises a fiber reinforced polymer.

According to an embodiment of the invention, the supporting part comprises a carbon fiber reinforced polymer.

According to an embodiment of the invention, the supporting part comprises a carbon fiber reinforced epoxy.

According to an embodiment of the invention, the supporting part comprises a carbon fiber reinforced polyester.

According to an embodiment of the invention, the supporting part is tubular shaped.

According to an embodiment of the invention, the wall thickness of the supporting part is constant along the longitudinal direction of the conductor. The supporting part may extend along the whole longitudinal direction of the conductor or only a part of the longitudinal direction of the conductor.

According to an embodiment of the invention, the wall thickness of the supporting part varies along the longitudinal direction of the conductor and where the supporting part may extend along the whole longitudinal direction of the conductor or only a part of the longitudinal direction of the conductor.

According to an embodiment of the invention, the supporting part extends along the whole longitudinal direction of the conductor and the wall thickness of the supporting part is larger than the average wall thickness of the supporting part at the ends and at the center of the longitudinal direction of the conductor the supporting part thereby give the conductor more stiffness where the conductor is highly stressed.

According to an embodiment of the invention, the supporting part comprises of two or more parts, each arranged where the conductor is highly stressed.

According to an embodiment of the invention, the supporting part comprises three parts, one arranged in the center part of the longitudinal direction of the conductor and two arranged at each end of the conductor and extending inside the hollow conductor towards the middle.

According to an embodiment of the invention, the supporting part comprises two parts, each arranged at the end of the conductor and extending inside the hollow insulator towards the middle.

According to an embodiment of the invention, the high voltage bushing is a gas insolated bushing.

Although various aspects of the invention are set out in the present embodiments, other aspects of the invention include the combination of any features presented in the described embodiments, and not solely the combinations explicitly set out.

BRIEF DESCRIPTION OF THE DRAWINGS

The drawings constitute a part of this specification and include exemplary embodiments to the invention, which may be embodied in various forms.

DETAILED DESCRIPTION OF THE INVENTION

Figure 1:
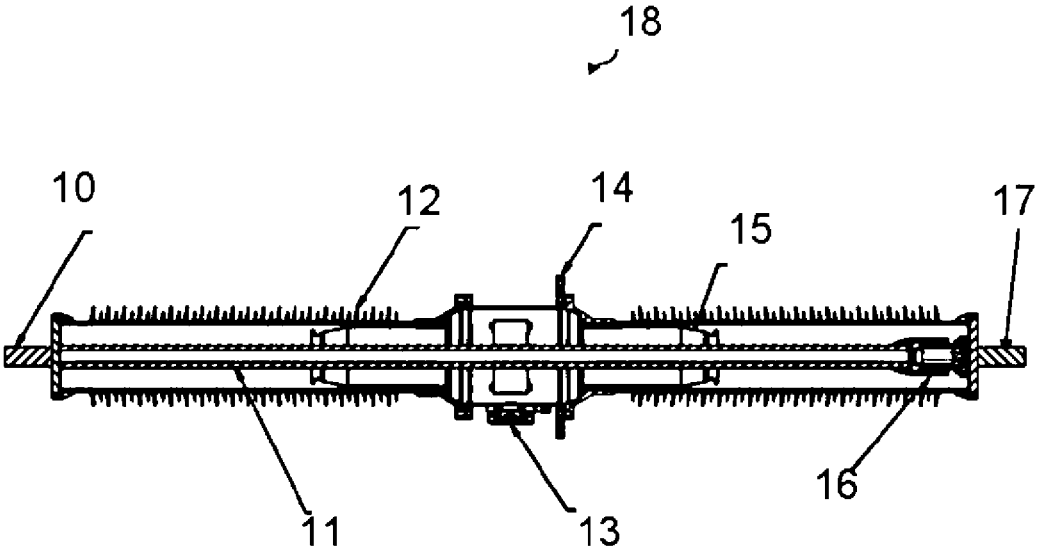
FIG. 1 shows a gas insulated bushing where the present invention could be used.

FIG. 1 shows a gas insulated bushing 18 where the present invention could be used. The bushing is assembled with a welded aluminium intermediate flange 14 (wall flange) fitted with two insulators 12, one for each side of the wall. Grading of the electrical field is accomplished by internal conical aluminium shields 15. The hollow conductor 11, extends through the hollow insulator 12 and is fixed at the ends 16 of the hollow insulator and is unsupported between. The insulators 12 consist of a glass fiber reinforced epoxy tube covered by weather sheds made of silicone rubber. The tubes are manufactured in one piece and equipped with glued on cast aluminium flanges at both ends. The design gives a rigid bushing with excellent mechanical properties. The bushing can be filled with isolating gas e.g. SF6 (sulfur hexafluoride). The isolating gas can be at atmospheric pressure or at an over pressure.

Figure 2:
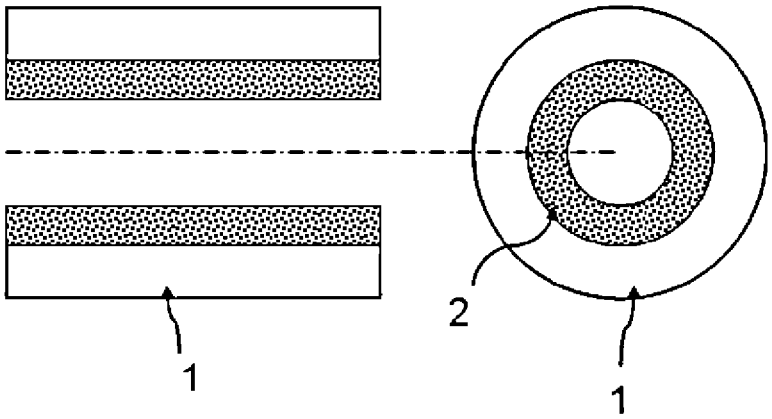
FIG. 2 shows a hollow conductor with a supporting part according to the present invention.

FIG. 2 shows a hollow conductor 1 with a supporting part 2 according to the present invention. The conductor can be aluminium, copper or alloys of them as is known in the art. The supporting part 2 can be made of fiber reinforced polymer.

The supporting part 2 in FIG. 2 shown here as a cross section shapes of a circle i.e. the supporting part 2 is tubular. The supporting part 2 is arranged to take up bending moments in the tubular conductor 11, making the combination conductor 11 and supporting part 2 more stiff than the conductor alone. In an embodiment of the present invention, the supporting part 2 is not fixed at the ends 16 of the hollow insulator therefore the supporting part 2 cannot take any pulling force or tension in the longitudinal direction from the deflection of the conductor in the horizontal direction.

Figure 3:
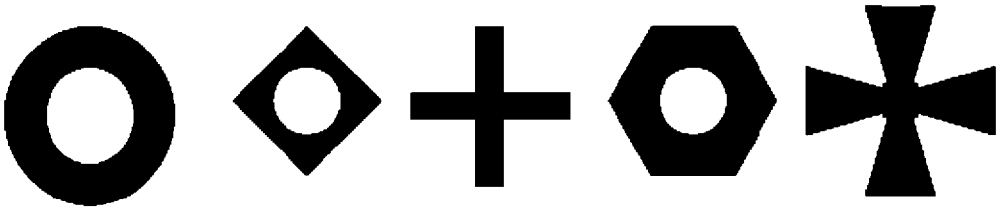
FIG. 3 shows different cross section shapes of the supporting part.

FIG. 3 shows different cross section shapes of the supporting part 2. Any shape that supports the conductor 1 is possible but there is a restriction of the weight of the supporting part 2 and a tubular shaped (left) supporting part 2 is preferred since it will give the conductor/supporting part system the most stiffness for a given weight of the supporting part.

Figure 4:
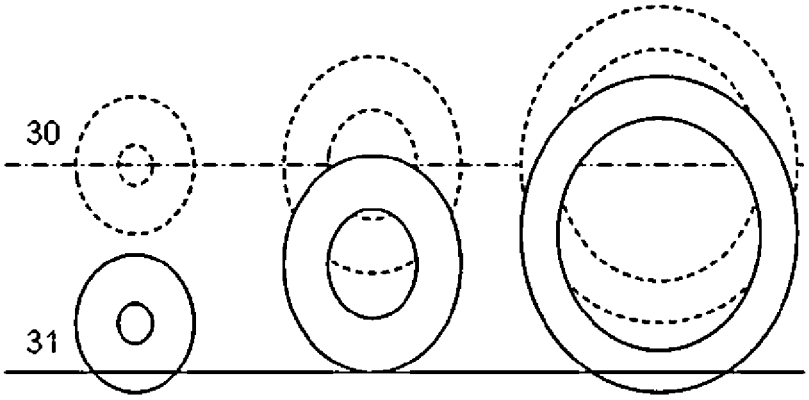
FIG. 4 shows the effect of deflection from the longitudinal center line during static load for different outer diameters of the tubular conductor.

FIG. 4 shows the effect of deflection from the longitudinal center line 30 during static load for different outer diameters of the tubular conductor 1. The conductor 1 is dimensioned to conduct a current i.e. for a given current and resistivity, the cross sectional surface of the conductor is given. For a conductor with a given outer diameter, the wall thickness of the tube will be determined by the cross sectional area. Smaller outer diameter (left) will give thick walls and larger outer diameter (right) will give thinner walls.

The dashed line 30 is the longitudinal center line of the conductor in the bushing and the place for the conductor without static deflection caused by gravity and the mass of the conductor. Dependent on the diameter of the conductor, the static deflection will be different. On the left side of FIG. 4, the conductor with small outer diameter will have a large deflection. On the right side of FIG. 4, the conductor with large outer diameter will have a smaller deflection from the longitudinal center line but the large outer diameter will affect the distance between the outer surface of the conductor and the hollow insulator inner wall or the inner shield.

The figure in the center of FIG. 4 shows an "optimal" diameter/wall thickness compared to the left figure and right figure of FIG. 4. It is "optimal" in the sense that it minimizes the distance between outer surface of the conductor and the inner wall of the hollow insulator during static load. The diameter of the conductor is large enough to give a smaller static deflection than the conductor on left side of FIG. 4, but the diameter of the conductor is not so large that it will affect the distance between the outer surface of the conductor and the hollow insulator inner wall.

Figure 5:
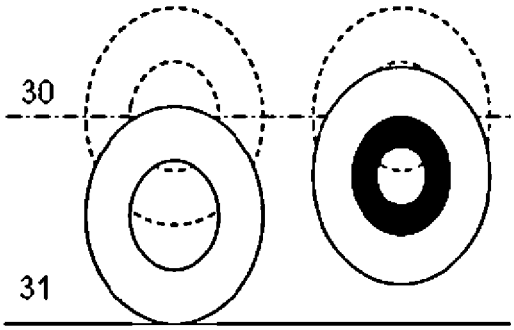
FIG. 5 shows the effect of a deflection from the longitudinal center line during static load with or without a supporting part.

FIG. 5 shows the effect of deflection from the longitudinal center line during static load with or without a supporting part 2. The arrangement with a supporting part (right) increases the stiffness and therefore decreases the deflection of the conductor, from the longitudinal center line 30. Dependent on the size and materials of the supporting part, the reduction of static deflection could be 50% or more.

Figure 6A:
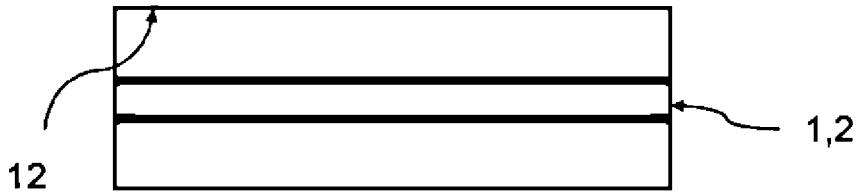
FIG. 6*a-d* shows different placements of the supporting part in the longitudinal direction of the tubular conductor.
Figure 6B:
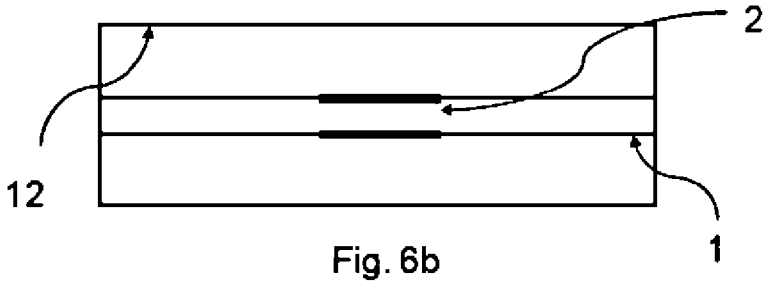
Figure 6C:
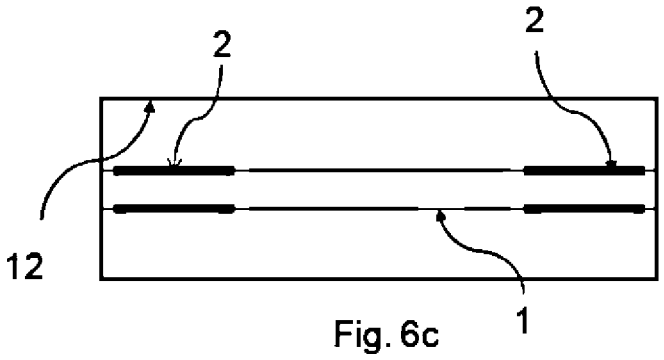
Figure 6D:
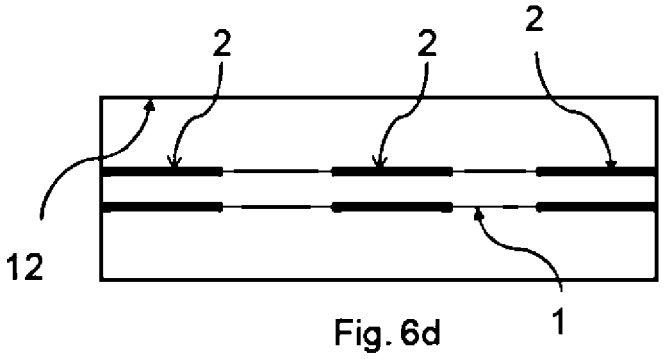

FIG. 6*a*-6*d* shows different placements of the supporting part 2 in the longitudinal direction of the tubular conductor 1 in the hollow insulator 12. The bending moments on the tubular conductor along the longitudinal direction will be largest at the ends 10, 17 where the conductor is fixed at the hollow insulator ends and at the center of the conductor. In FIG. 6*a*, the supporting part 2 is arranged along the whole tubular conductor 1. There might be a requirement to keep the added weight by a supporting part as low as possible. Therefore, the supporting part can be shorter than the full length of the conductor and arranged around longitudinal center of the tubular conductor (FIG. 6*b*). Another solution is to have two supporting parts, each arranged at the ends of the conductor (FIG. 6*c*) where bending moments are large. Another solution is to have three supporting parts (FIG. 6*d*), one arranged around longitudinal center and two at each end of the conductor. In this configuration the supporting parts are arranged where the material stress is the largest. The sum of total length of the supporting parts 2 are less than full length of the conductor.

Figure 7:
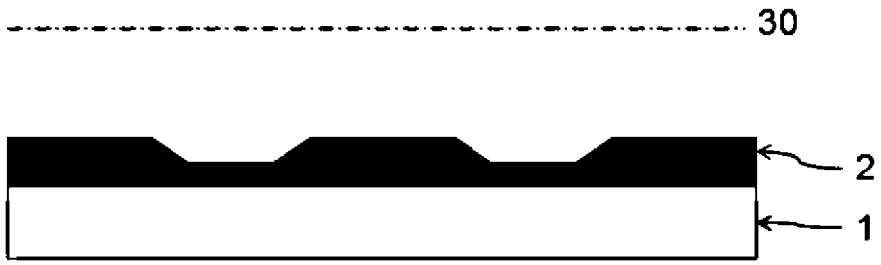
FIG. 7 shows a cutout of a hollow conductor with a supporting part according to one embodiment of the present invention.

FIG. 7 shows cutout of a hollow conductor 1 with a supporting part 2 according to one embodiment of the present invention. The dashed line 30 is the longitudinal center line of the conductor.

The supporting part can be tubular shaped but with different thickness and stiffness along the longitudinal direction. Preferably the supporting part will be arranged with a bigger wall thickness and higher stiffness at the center and/or at each end of the conductor.

The supporting part in a tubular conductor has advantages for reducing the static deflection from gravity. The supporting part also has advantages for dynamic deflection e.g. from earthquakes.

For a major earthquake the peak acceleration (ZPA, Zero Period Acceleration) is 0.5-0.3 g (=3-5 $m/s^2$) and for a moderate earthquake about 0.2 g (=2 $m/s^2$), and the frequency range of the largest vibrations in an earthquake is normally in the range of 1-10 Hz.

If the acceleration from an earthquake was only added to the acceleration of the gravity, a conductor deflection would be an additional 20%-50% of the deflection from gravity, which is on the order of a few centimeters for standard conductor diameters.

The problem with the acceleration from an earthquake is that it changes direction, and if the frequency of the earthquake is the same as resonant frequency of the conductor, the conductor deflection might start to self-oscillate with increasing amplitude. If the conductor should connect with the earthed shield 15 on the inside of the hollow insulator, either by direct contact or by an arc, a catastrophic short circuit would ensure.

The supporting part will change the resonant frequency of the conductor and if properly designed make the conductor more safe for self-oscillations induced by earthquakes by changing the resonant frequency of the conductor.

What is claimed is:

1. A high voltage bushing comprising;

a hollow insulator, a conductor extending through the hollow insulator and including a hollow conductor fixed at the ends of the hollow insulator and unsupported by the insulator between the fixed ends, characterized in that the conductor comprises a supporting part arranged inside the hollow conductor, the supporting part extends in the longitudinal direction of the hollow conductor remains effectively stationary within the hollow conductor, and the supporting part supports the horizontal length of the hollow conductor in order to increase the stiffness of the conductor and thereby decrease the static deflection of the conductor in the hollow insulator, wherein the bushing is a gas insulated bushing.

2. The high voltage bushing according to claim 1, wherein an angle between the longitudinal direction of the conductor and a horizontal plane is less than 40 deg.

3. The high voltage bushing according to claim 1, wherein the increased stiffness of the hollow conductor with the supporting part makes the static deflection of the hollow conductor with the supporting part less than the static deflection for the hollow conductor alone, even though the supporting part adds weight to the conductor.

4. The high voltage bushing according to claim 1, wherein the supporting part changes the resonant frequency of the conductor, which damps the oscillations during an earth quake.

5. The high voltage bushing according to claim 1, wherein the supporting part comprises a fiber reinforced polymer.

6. The high voltage bushing according to claim 5, wherein the supporting part comprises a carbon fiber reinforced polymer.

7. The high voltage bushing according to claim 6, wherein the supporting part comprises a carbon fiber reinforced epoxy or carbon fiber reinforced polyester.

8. The high voltage bushing according to claim 1, wherein the supporting part is tubular shaped.

9. The high voltage bushing according to claim 8, wherein the wall thickness of the supporting part is constant along the longitudinal direction of the conductor.

10. The high voltage bushing according to claim 8, wherein the wall thickness of the supporting part varies along the longitudinal direction of the conductor.

11. The high voltage bushing according to claim 8, wherein the supporting part extends along the whole longitudinal direction of the conductor and the wall thickness of the supporting part is larger than the average wall thickness of the supporting part at the ends and at the center of the longitudinal direction of the conductor.

12. The high voltage bushing according to claim 1, wherein the supporting part comprises two or more parts, each arranged where the conductor stress is the largest.

13. The high voltage bushing according to claim 12, wherein the supporting part comprises two parts, each arranged at the end of the conductor and extending inside the hollow insulator towards the middle.

14. The high voltage bushing according to claim 1, wherein the supporting part comprises three parts, one arranged in the center part of the longitudinal direction of the conductor and two arranged at each end of the conductor and extending inside the hollow conductor towards the middle.

15. The high voltage bushing according to claim 1, wherein the gas is sulfur hexafluoride.

16. The high voltage bushing according to claim 1, wherein the gas is provided at atmospheric pressure.

17. The high voltage bushing according to claim 1, wherein said supporting part comprises fiber reinforced polymer.

18. A high voltage bushing comprising:

a hollow insulator;

a conductor extending through the hollow insulator and including a hollow conductor fixed at the ends of the hollow insulator where the conductor includes a tubular shaped supporting part arranged inside the hollow conductor, the supporting part extends in the longitudinal direction of the hollow conductor and remains effectively stationary within the hollow conductor, and the supporting part supports the horizontal length of the hollow conductor in order to increase the stiffness of the conductor to decrease the static deflection of the conductor in the hollow insulator;

wherein the supporting part extends along the whole longitudinal direction of the conductor and the wall thickness of the supporting part is larger than the average wall thickness of the supporting part at the ends and at the center of the longitudinal direction of the conductor.

19. A high voltage bushing comprising:

a hollow insulator;

a conductor extending through the hollow insulator and including a hollow conductor fixed at the ends of the hollow insulator where the conductor includes a tubular shaped supporting part arranged inside the hollow conductor, the supporting part extends in the longitudinal direction of the hollow conductor and remains effectively stationary within the hollow conductor, and the supporting part supports the horizontal length of the hollow conductor in order to increase the stiffness of the conductor to decrease the static deflection of the conductor in the hollow insulator;

wherein the supporting part comprises three parts, one arranged in the center part of the longitudinal direction of the conductor and two arranged at each end of the conductor and extending inside the hollow conductor towards the middle.

20. A high voltage bushing comprising:

a hollow insulator;

a conductor extending through the hollow insulator and including a hollow conductor fixed at the ends of the hollow insulator where the conductor includes a tubular shaped supporting part arranged inside the hollow conductor, the supporting part extends in the longitudinal direction of the hollow conductor and remains effectively stationary within the hollow conductor, and the supporting part supports the horizontal length of the hollow conductor in order to increase the stiffness of the conductor to decrease the static deflection of the conductor in the hollow insulator;

said supporting part comprises two or more parts, each arranged where the conductor stress is the largest;

wherein the two or more parts are arranged along only a portion of a longitudinal axis of the conductor through the bushing.

21. The high voltage bushing according to claim 20, wherein the two or more parts are arranged at different longitudinal positions along the longitudinal axis of the conductor.

* * * * *